US007922524B2

(12) United States Patent
Huang et al.

(10) Patent No.: US 7,922,524 B2
(45) Date of Patent: Apr. 12, 2011

(54) ELECTRICAL CONNECTOR FOR HIGH-DEFINITION (HD) DIGITAL IMAGES

(75) Inventors: Chung-Pin Huang, Sijhih (TW); Chu-Hsueh Lee, Young-Ho (TW); Chia-Nan Ho, Taipei (TW)

(73) Assignee: Wieson Technologies Co., Ltd., Taipei (TW)

( * ) Notice: Subject to any disclaimer, the term of this patent is extended or adjusted under 35 U.S.C. 154(b) by 0 days.

(21) Appl. No.: 12/628,367

(22) Filed: Dec. 1, 2009

(65) Prior Publication Data

US 2011/0039450 A1 Feb. 17, 2011

(30) Foreign Application Priority Data

Aug. 11, 2009 (TW) ..... 98214793 U

(51) Int. Cl.
*H01R 13/60* (2006.01)

(52) U.S. Cl. ..... 439/541.5; 439/79

(58) Field of Classification Search ..... 439/79, 439/80, 541.5
See application file for complete search history.

(56) References Cited

U.S. PATENT DOCUMENTS

| | | | | | |
|---|---|---|---|---|---|
| 4,878,856 | A * | 11/1989 | Maxwell | 439/541.5 |
| 5,085,590 | A * | 2/1992 | Galloway | 439/95 |
| 5,167,531 | A * | 12/1992 | Broschard et al. | 439/541.5 |
| 5,613,875 | A * | 3/1997 | Yang | 439/541.5 |
| 5,643,008 | A * | 7/1997 | Tan et al. | 439/541.5 |
| 6,302,731 | B1 * | 10/2001 | Kring | 439/541.5 |
| 7,618,285 | B2 * | 11/2009 | Xiang et al. | 439/541.5 |
| 7,677,923 | B1 * | 3/2010 | Chen et al. | 439/541.5 |
| 7,699,627 | B2 * | 4/2010 | Xiang et al. | 439/79 |

* cited by examiner

*Primary Examiner* — Thanh-Tam T Le
(74) *Attorney, Agent, or Firm* — Roger H. Chu

(57) ABSTRACT

The present invention relates to an improved electrical connector adapted to transmit high-definition (HD) digital images. The improved electrical connector comprises a body, a first terminal assembly, a second terminal assembly, a first terminal connecting device, a second terminal connecting device, a first housing and a second housing. The first terminal assembly and the second terminal assembly are adapted to transmit signals, and by using the first housing and the second housing to cover the first terminal assembly and the second terminal assembly simultaneously, the problem of electromagnetic interference (EMI) suffered by the first terminal assembly and the second terminal assembly during high-frequency transmission is obviated, thereby improving the electromagnetic disturbance susceptibility thereof.

11 Claims, 7 Drawing Sheets

ELECTRICAL CONNECTOR FOR HIGH-DEFINITION (HD) DIGITAL IMAGES

CROSS-REFERENCE TO RELATED APPLICATION

This application claims foreign priority from a Taiwan Patent Application, Ser. No. 098214793, filed on Aug. 11, 2009.

BACKGROUND OF THE INVENTION

1. Technical Field

The present invention relates to electrical connectors, and more particularly, to an improved electrical connector that can transmit high-definition (HD) digital signals through a first terminal assembly and a second terminal assembly simultaneously and obviate electromagnetic interference (EMI) and improve disturbance by covering the first terminal assembly and the second terminal assembly with a first housing and a second housing, respectively.

2. Description of Related Art

With the advent of the digital audio & video (AV) times, various hardware equipment associated with 3C AV products have been constantly developed and upgraded. For connection between different hardware equipment, demands on associated electrical connectors also become ever higher accordingly.

Among the digital AV products, liquid crystal displays (LCDs) for use with computers and high-definition (HD) liquid crystal TV sets for home use are the best sold ones. Therefore, digital AV products capable of outputting digital AV signals directly have been developed by the manufacturers in succession for use in combination with the LCDs and HD liquid crystal TV sets, for example, computer display cards, Blu-ray DVD players, HD projectors and the like. All these products are provided with at least one connector that is known as a digital visual interface (DVI).

As a kind of electrical connector for use to transmit HD digital AV signals, the DVI connector is able to transmit both digital signals and analog signals, and support digital video display apparatuses such as HD liquid crystal TV sets. The DVI connector is adapted to transmit uncompressed HD digital video signals, and can provide high-quality large frames free of radiations to allow the user to enjoy a better visual effect.

Most of the conventional DVI connectors that are currently used are of a single-layered structure, which is unable to meet with demands for use of multiple screens. Moreover, the conventional DVI connectors failed to have transmission terminals thereof particularly adjusted in length, width and thickness to minimize the equivalent capacitance during transmission. Therefore, electromagnetic interference and electromagnetic susceptibility might occur to the conventional DVI connectors during high-frequency transmission, causing failure in fully providing the expected performance.

Accordingly, in view of the drawbacks and shortcomings of the conventional DVI connectors, the present inventor has made great efforts to make improvement thereon, and finally provides an improved electrical connector of the present invention.

SUMMARY OF THE INVENTION

The primary objective of the present invention is to provide an improved electrical connector, which can transmit high-definition (HD) digital signals through a first terminal assembly and a second terminal assembly simultaneously and, by covering the first terminal and the second terminal with a first housing and a second housing, respectively, obviate electromagnetic interference suffered by the first terminal and the second terminal during high-frequency transmission, thereby improving the electromagnetic disturbance susceptibility.

Accordingly, to accomplish the above-mentioned objective, the present inventor proposes an improved electrical connector for use to transmit high-definition (HD) digital images. The improved electrical connector comprises: a body, being provided with a terminal connection base; a first terminal assembly, being connected to the terminal connection base at an end thereof and configured to transmit a signal; a second terminal assembly, being connected to the terminal connection base at an end thereof and configured to transmit a signal; a first terminal connecting device, being disposed on the body and having a first connecting body for receiving the first terminal assembly therein; a second terminal connecting device, being disposed on the body and having a second connecting body for receiving the second terminal assembly therein; a first housing, covering the first terminal assembly and being adapted to maintain the integrity of signal transmission of the first terminal assembly; and a second housing, being disposed on the body and covering the first housing to prevent electromagnetic interference (EMI) suffered by the first terminal assembly and the second terminal assembly during high-frequency transmission and improve the electromagnetic disturbance susceptibility.

BRIEF DESCRIPTION OF THE SEVERAL VIEWS OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE INVENTION

To describe the improved electrical connector proposed in the present invention more clearly, a detailed description will be made with reference to the attached drawings.

Figure 1:
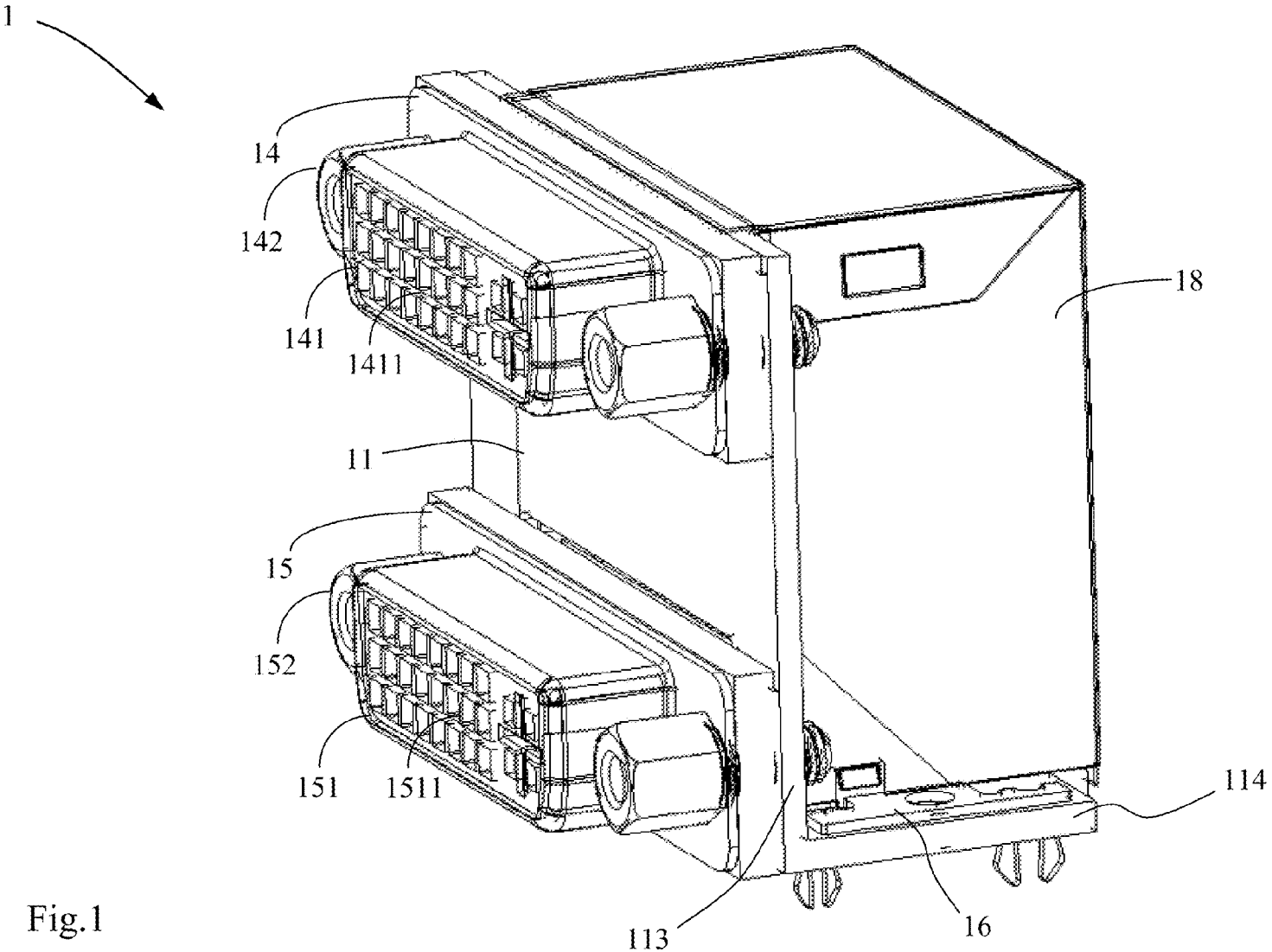
FIG. 1 is a perspective view of an improved electrical connector according to the present invention.
Figure 2:
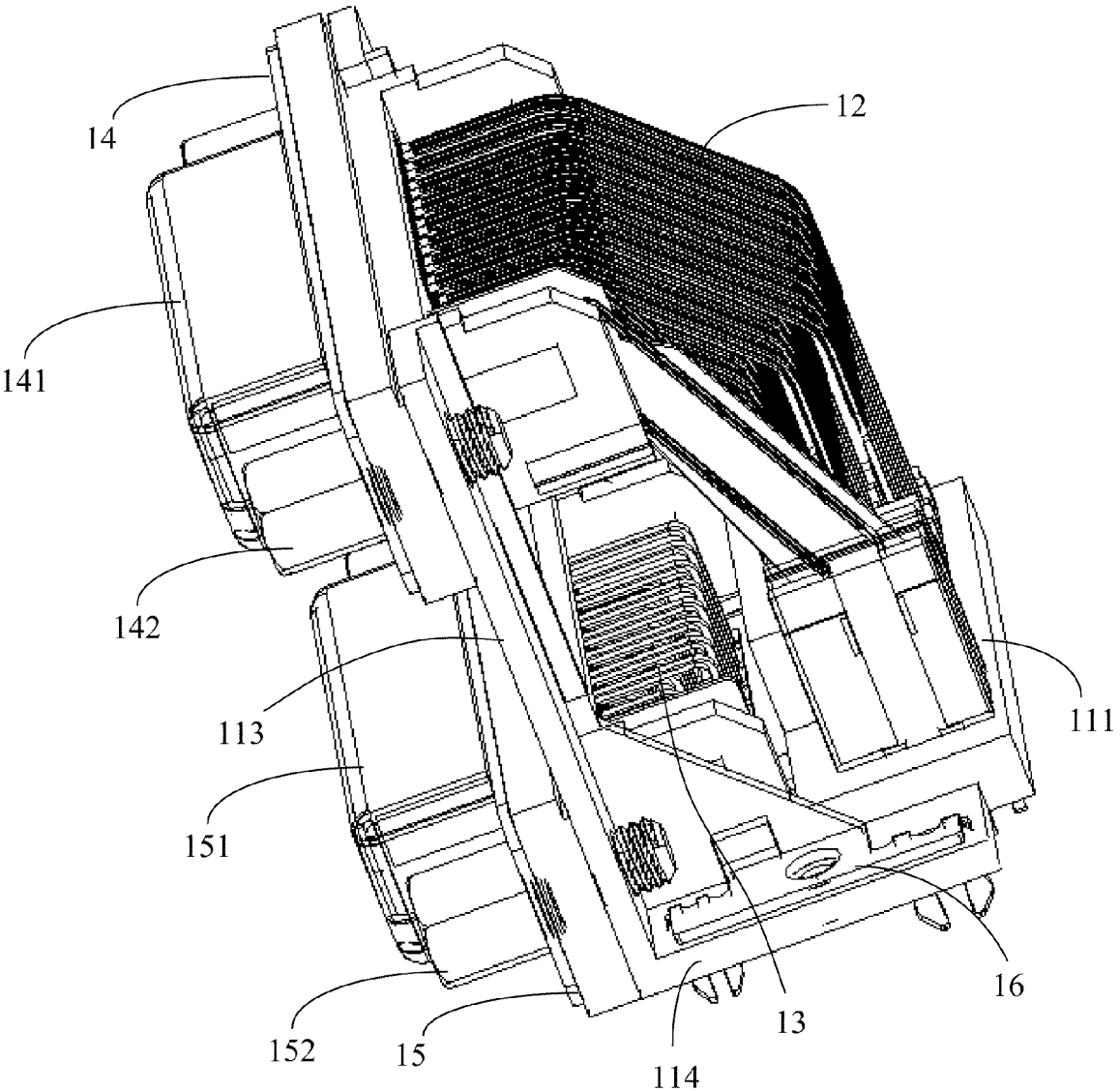
FIG. 2 is a perspective view of the improved electrical connector from another viewing angle.

Referring to FIGS. 1 and 2 together, according to the present invention, a perspective view of the improved electrical connector and a perspective view of the improved electrical connector from another viewing angle are shown therein, respectively. The improved electrical connector 1, which is for use to transmit HD digital images, comprises a body 11, a first terminal assembly 12, a second terminal assembly 13, a first terminal connecting device 14, a second terminal connecting device 15, a first housing 17, a second housing 18 and two harpoon-shaped terminal assemblies 16.

The body 11 has a major side 113 and a minor side 114 which are perpendicular to each other to form an L shape, and a terminal connecting base 111 is disposed on the minor side 114.

Figure 3:
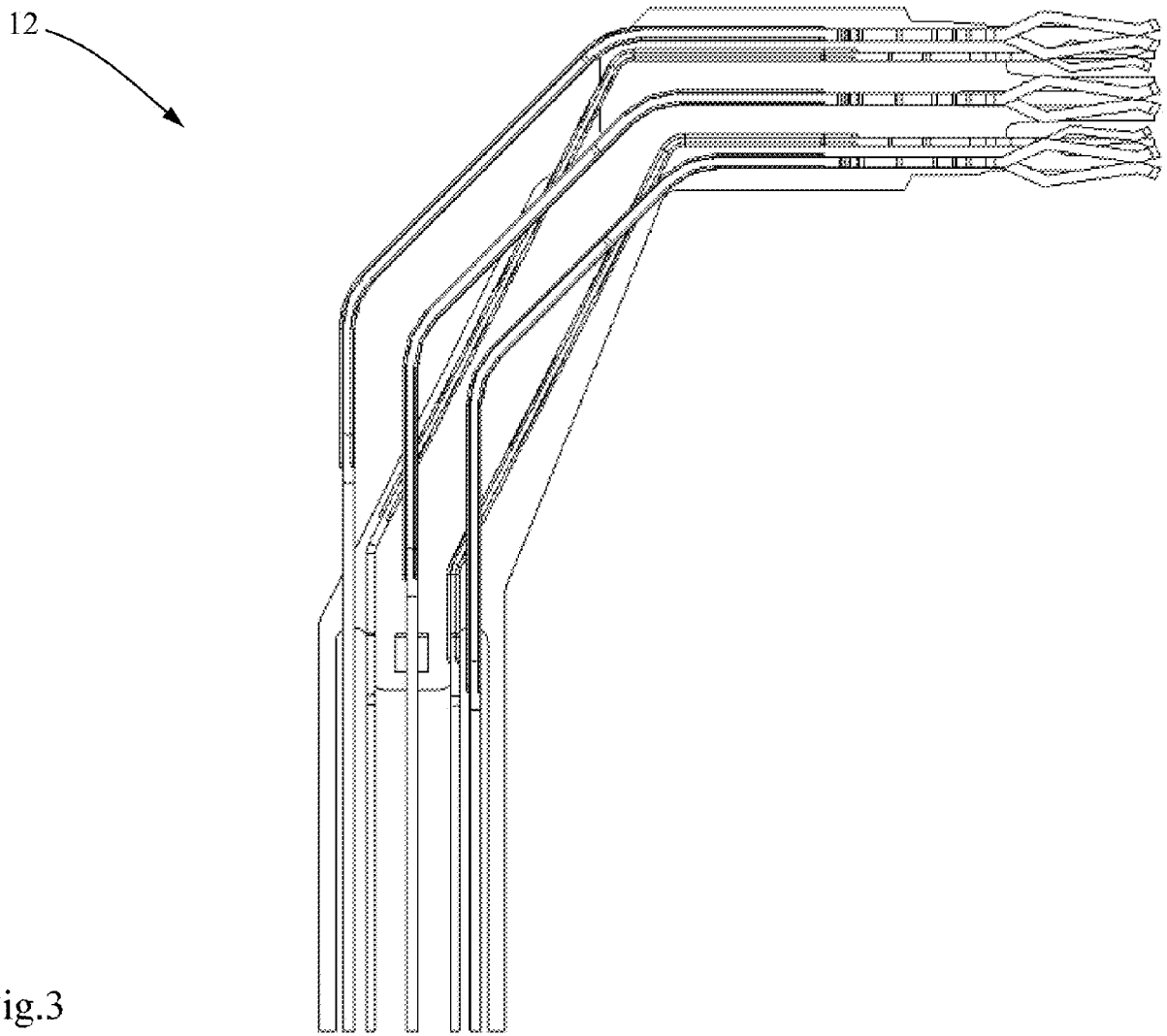
FIG. 3 is a perspective view of a first terminal assembly of the improved electrical connector.
Figure 6:
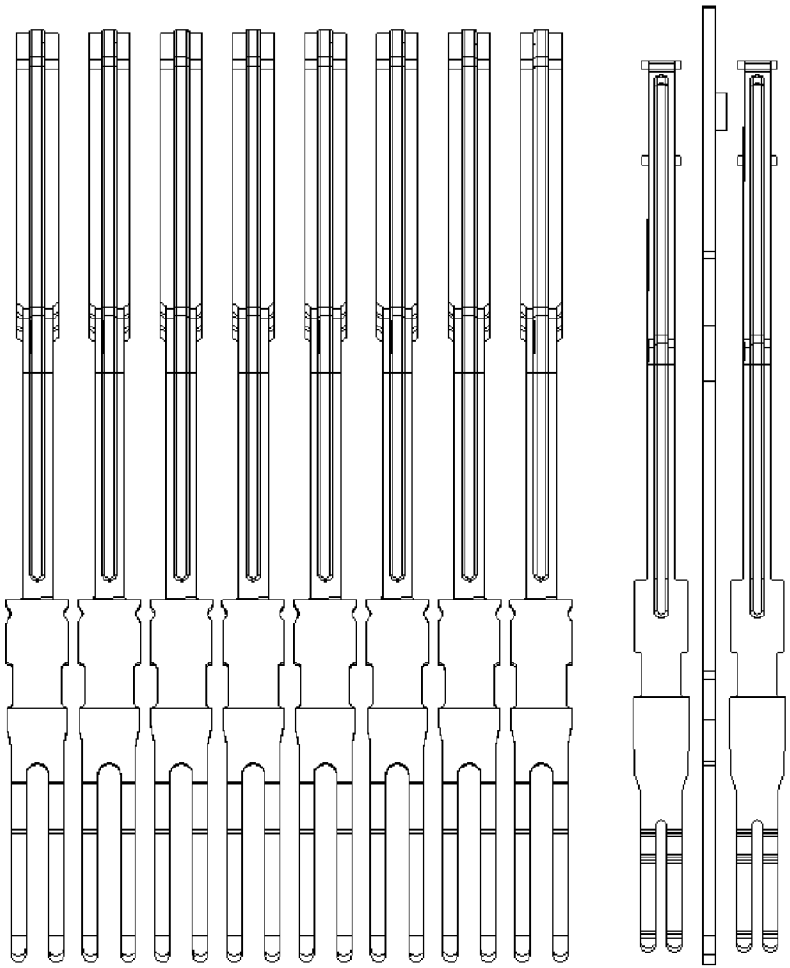
FIG. 6 is a top view of a first terminal of the improved electrical connector.
Figure 7:
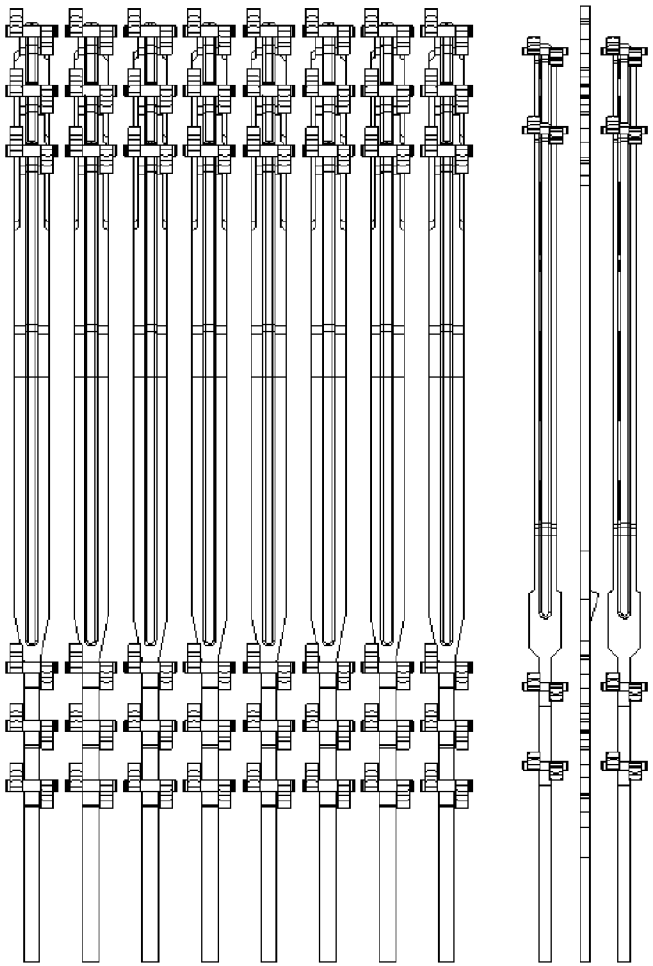
FIG. 7 is a back view of the first terminal of the improved electrical connector.

The first terminal assembly 12 is connected to the terminal connecting base 111 at an end thereof. Referring to FIG. 3 together, a perspective view of the first terminal assembly is shown therein. The first terminal assembly 12 takes two angular bends, the range of the bend angle is between 120° and 150°. Because the first terminal assembly 12 has a long length, the two bends may improve the equivalent capacitance of the first terminal assembly 12 during signal transmission, so as to obtain a better signal transmission effect by reducing the impedance. Additionally, referring to FIGS. 6 and 7 together, a top view and a back view of the first terminal assembly are shown therein, respectively. In a preferred embodiment, by adjusting a width and a thickness of the terminals (variation in thickness is not shown) of the first terminal assembly 12, the equivalent capacitance of the terminals of the first terminal assembly 12 is made to be constant along the transmission path during signal transmission, thereby obtaining the optimal impedance matching and continuity effect. Thus, the first terminal assembly 12 may still maintain desirable signal transmission performance during high-frequency transmission.

The second terminal assembly 13 is connected to the terminal connecting base 111 at an end thereof and adapted to transmit a signal. In this embodiment, the second terminal assembly 13 has a short length and, therefore, needs not to be took any angular bend to decrease the impedance. However, as with the first terminal assembly 12, the second terminal assembly 13 of this embodiment also has a width and a thickness of terminals thereof varied in order to obtain a better signal transmission effect.

The first terminal connecting device 14 is disposed on the major side 113 of the body 11 and comprises a first connecting body 141. The first connecting body 141 has a plurality of first receiving holes 1411 for receiving the first terminal assembly 12 therein. Furthermore, through the first connecting body 141, the first terminal assembly 12 can be connected to external terminals.

The second terminal connecting device 15 is disposed on the body 11 and comprises a second connecting body 151. The second connecting body 151 has a plurality of second receiving holes 1511 for receiving the second terminal assembly 13 therein. Furthermore, through the second connecting body 151, the second terminal assembly 13 can be connected to external terminals.

Figure 4:
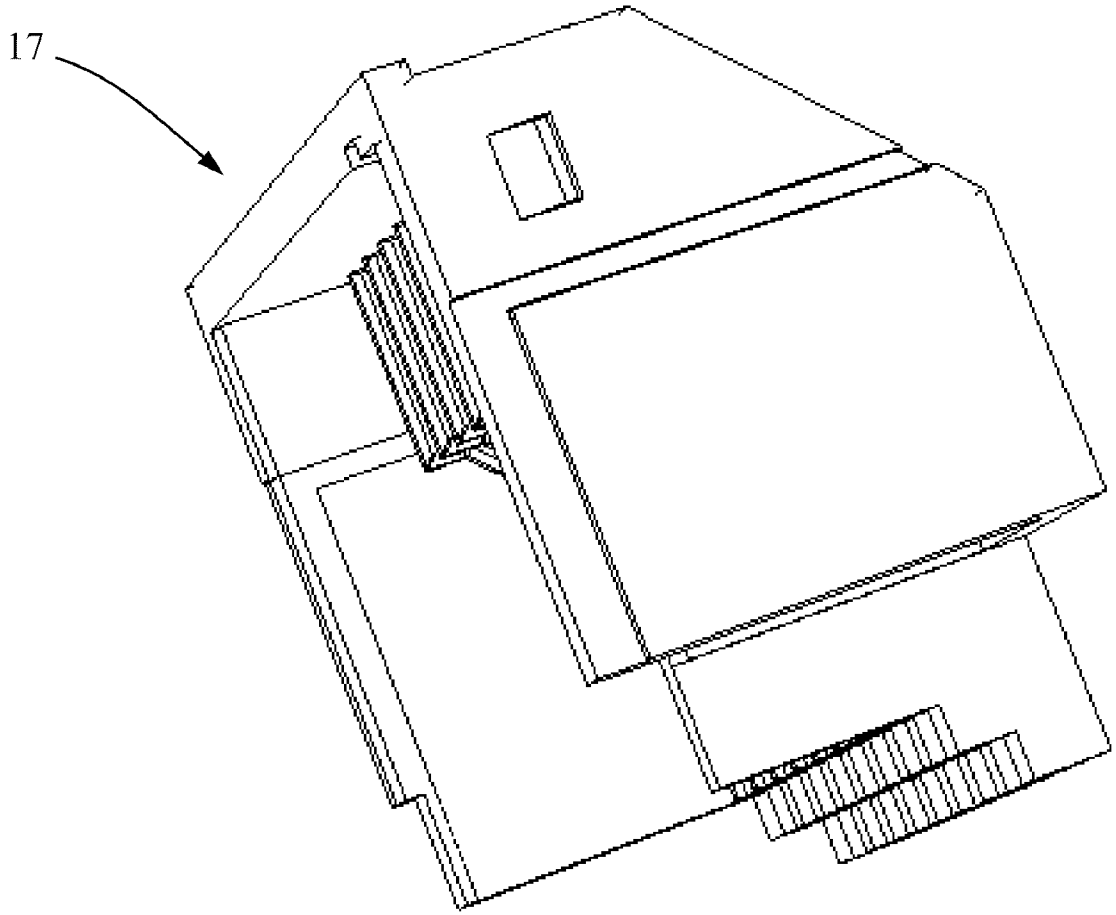
FIG. 4 is a perspective view of a first housing of the improved electrical connector.

The first housing 17 covers the first terminal assembly 12. Referring back to FIG. 4, a perspective view of the first housing of the improved electrical connector is shown therein. Preferably in this embodiment, the first housing 17 is an insulation-housing. The first housing 17 may have relative positions of the terminals of the first terminal assembly 12 appropriately arranged and fixed to enhance the mechanical strength of the first terminal assembly 12. Moreover, the first housing 17 is able to maintain the integrity of signal transmission of the first terminal assembly 12 to obviate electromagnetic interference suffered by the first terminal assembly 12 during high-frequency transmission.

The second housing 18 is disposed on the body 11 and covers the first housing 17. Preferably in this embodiment, the second housing 18 is a metal housing. By using the first housing 17 and the second housing 18 to cover the first terminal assembly 12 and the second terminal assembly 13 simultaneously, this embodiment can obviate the problem of electromagnetic interference suffered by the first terminal assembly 12 and the second terminal assembly 13 during high-frequency transmission, thereby improving the electromagnetic disturbance susceptibility.

The two harpoon-shaped terminal assemblies 16 are disposed at two sides of the minor side 114, respectively, and each has two harpoon-shaped terminals. Hence, by means of the harpoon-shaped terminal assemblies 16, the improved electrical connector 1 can be installed on an external printed circuit board (PCB).

Figure 5:
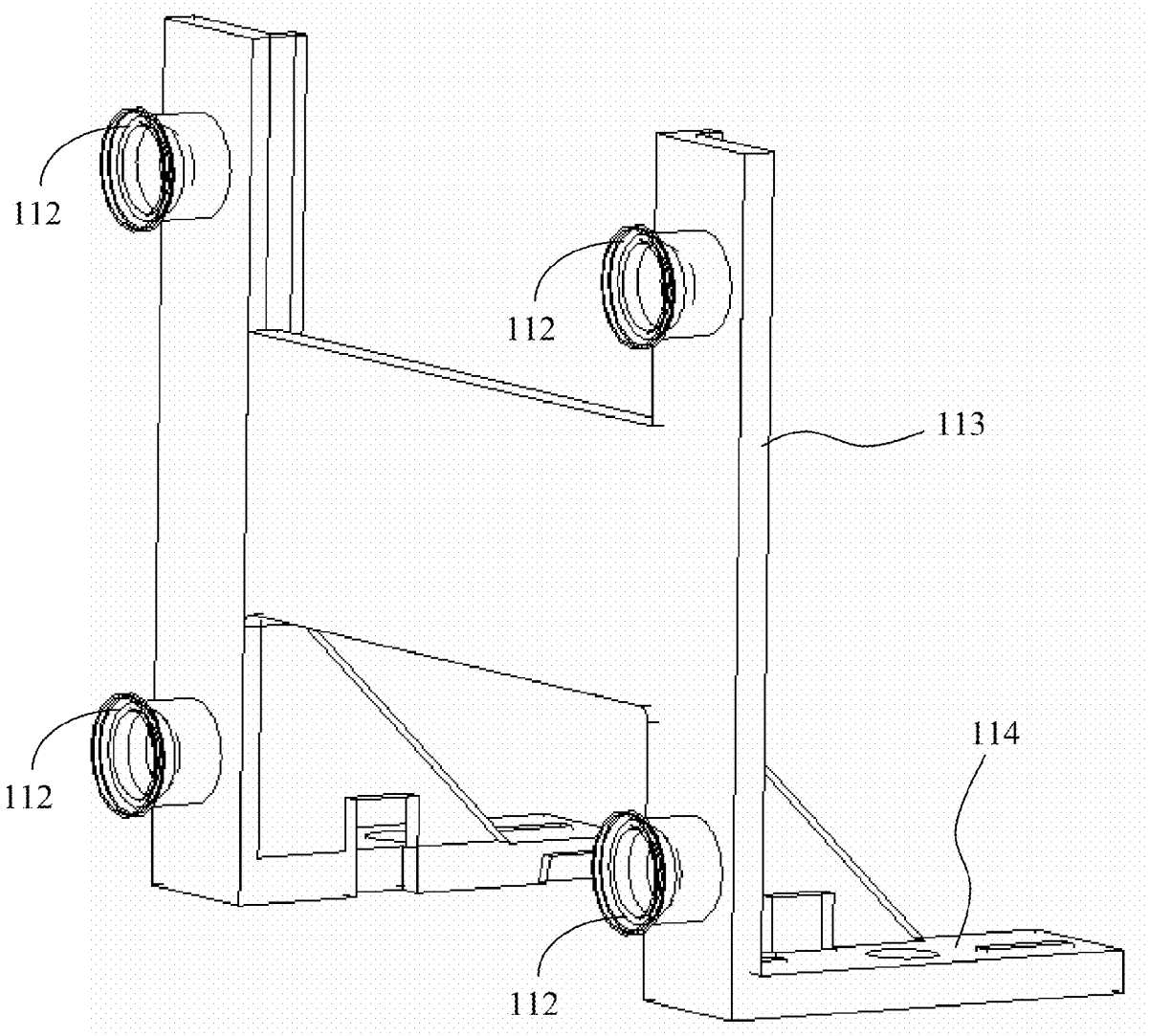
FIG. 5 is a perspective view of a body of the improved electrical connector.

Referring to FIG. 5 again, a perspective view of a body of the improved electrical connector is shown therein. In the above-mentioned preferred embodiment of the improved electrical connector 1, the body 11 has four threaded holes 112 disposed at two sides of the major side 113, respectively. Referring also to FIG. 1, the first terminal connecting device 14 and the second terminal connecting device 15 further comprise two first bolts 142 and two second bolts 152, respectively. By use of the first bolts 142 and the second bolts 152, the first terminal connecting device 14 and the second terminal connecting device 15 can be latched onto the body 11 to form the improved electrical connector 1 of a dual-layered structure.

Accordingly, from the above description of the improved electrical connector of the present invention, advantages of the present invention may be summarized as follows:

1. The present invention may be applied to transmit HD digital images, and through the design of a dual-layered structure, is more helpful to meet with demands for hardware when multiple video outputs are needed.
2. By use of the two angular bends, equivalent capacitance of the first terminal assembly during signal transmission is improved and, consequently, impedance thereof is decreased, thereby obtaining a better signal transmission effect.
3. By using the first housing (an insulation-housing) and the second housing (a metal housing) to cover the first terminal assembly and the second terminal assembly simultaneously, the problem of electromagnetic interference suffered by the first terminal assembly and the second terminal assembly is mitigated, thereby improving the electrical magnetic sustainment. This allows the first terminal assembly and the second terminal assembly to fully provide the signal transmission performance thereof.

What is claimed is:

1. An improved electrical connector with high electromagnetic susceptibility adapted to transmit high-definition (HD) digital images, the improved electrical connector comprising:

a body, being provided with a terminal connecting base, and having a major side and a minor side that are connected perpendicularly to each other to form an L-shaped body, wherein the terminal connecting base is disposed on the minor side;

a first terminal assembly, being connected to the terminal connecting base at an end thereof, wherein by having the first terminal assembly take multiple angular bends and adjusting a width and a thickness of the first terminal assembly, an equivalent capacitance of the first terminal assembly during signal transmission is increased to decrease an impedance thereof, thereby improving a signal transmission effect; and a second terminal assembly, being connected to the terminal connecting base at an end thereof, wherein the second terminal assembly is for use to transmit a signal, and by adjusting a width and a thickness of the second terminal assembly, an equivalent capacitance of the second terminal assembly during signal transmission is increased to decrease an impedance thereof, thereby improving a signal transmission effect;

a first terminal connecting device, being disposed on the body, wherein the first terminal connecting device comprises a first connecting body for accommodating the first terminal assembly therein, and through the first connecting body, the first terminal assembly is allowed to be connected to external terminals;

a second terminal connecting device, being disposed on the body, wherein the second terminal connecting device comprises a second connecting body for accommodating the second terminal assembly therein, and through the second connecting body, the second terminal assembly is allowed to be connected to external terminals;

at least one harpoon-shaped terminal assembly, being disposed on the minor side of the body and allowing the improved electrical connector to be installed on an external printed circuit board (PCB);

a first housing, covering the first terminal assembly, wherein the first housing has relative positions of the terminals of the first terminal assembly appropriately arranged and fixed to enhance a mechanical strength of the first terminal assembly, and the first housing is able to maintain the integrity of signal transmission of the first terminal assembly and obviate the problem of electromagnetic interference suffered by the first terminal assembly during high-frequency transmission; and a second housing, being disposed on the body and covering the first housing to obviate electromagnetic interference (EMI) suffered by the first terminal assembly and the second terminal assembly during high-frequency transmission, thereby improving the electromagnetic disturbance susceptibility.

2. The improved electrical connector of claim 1, wherein the first terminal connecting device further comprises at least one first bolt that allows the first terminal connecting device to be latched onto the body.

3. The improved electrical connector of claim 1, wherein the second terminal connecting device further comprises at least one second bolt that allows the second terminal connecting device to be latched onto the body.

4. The improved electrical connector of claim 1, wherein the first housing is a metal housing or an insulation-housing.

5. The improved electrical connector of claim 1, wherein the second housing is a metal housing or an insulation-housing.

6. The improved electrical connector of claim 1, wherein the first connecting body has a plurality of first accommodating holes for accommodating the first terminal assembly.

7. The improved electrical connector of claim 1, wherein the second connecting body has a plurality of second accommodating holes for accommodating the second terminal assembly.

8. The improved electrical connector of claim 1, wherein the major side is formed with a plurality of threaded holes to assist in installing the first terminal connecting device and the second terminal connecting device to the body.

9. The improved electrical connector of claim 1, wherein the first terminal connecting device and the second terminal connecting device are disposed on the major side.

10. The improved electrical connector of claim 1, wherein a number of the angular bends of the first terminal assembly is two.

11. The improved electrical connector of claim 1, wherein the each of the angular bends of the first terminal assembly defines an included obtuse angle ranges between 120° and 150°.

* * * * *